US008708383B1

(12) United States Patent
Roberts et al.

(10) Patent No.: US 8,708,383 B1
(45) Date of Patent: Apr. 29, 2014

(54) BUCKET LIFTING ASSEMBLY

(71) Applicants: Michael J. Roberts, Frankfort, IN (US); Ladawna J. Roberts, Frankfort, IN (US)

(72) Inventors: Michael J. Roberts, Frankfort, IN (US); Ladawna J. Roberts, Frankfort, IN (US)

( * ) Notice: Subject to any disclaimer, the term of this patent is extended or adjusted under 35 U.S.C. 154(b) by 0 days.

(21) Appl. No.: 13/742,553

(22) Filed: Jan. 16, 2013

(51) Int. Cl.
*B66C 1/00* (2006.01)

(52) U.S. Cl.
USPC ..... 294/67.33; 414/607

(58) Field of Classification Search
USPC ..... 294/67.33, 67.3, 81.54, 81.56, 81.62, 294/34, 82.13, 90; 414/607
See application file for complete search history.

(56) References Cited

U.S. PATENT DOCUMENTS

| | | | | |
|---|---|---|---|---|
| 1,624,320 | A * | 4/1927 | Demmer | 452/189 |
| 2,542,621 | A * | 2/1951 | Bober | 294/34 |
| 2,595,182 | A * | 4/1952 | Weingarten | 104/93 |
| 2,696,317 | A * | 12/1954 | Toffolon | 414/607 |
| 3,588,163 | A * | 6/1971 | Wald | 294/68.3 |
| 4,073,175 | A * | 2/1978 | Seamon | 72/325 |
| 4,823,433 | A | 4/1989 | Curtis | |
| D306,507 | S | 3/1990 | Lund | |
| 5,145,226 | A | 9/1992 | LaFontaine | |
| 5,445,425 | A | 8/1995 | Lyver | |
| 5,501,497 | A | 3/1996 | Holloway | |
| 5,967,582 | A * | 10/1999 | Saito | 294/110.1 |
| 6,382,691 | B2 | 5/2002 | Hazelton | |
| 6,497,006 | B2 | 12/2002 | Gallup | |
| 6,749,392 | B1 * | 6/2004 | Adams et al. | 414/800 |
| 7,284,777 | B1 | 10/2007 | Kraemer | |
| 7,399,017 | B1 | 7/2008 | Lasseigne | |
| 2010/0148528 | A1 * | 6/2010 | Emond et al. | 294/67.33 |
| 2013/0249226 | A1 * | 9/2013 | Marshall | 294/34 |

FOREIGN PATENT DOCUMENTS

| | | | | |
|---|---|---|---|---|
| JP | 06144769 | A * | 5/1994 | B66C 1/28 |

* cited by examiner

*Primary Examiner* — Saul Rodriguez
*Assistant Examiner* — Gabriela Puig
(74) *Attorney, Agent, or Firm* — Kyle Fletcher

(57) ABSTRACT

The bucket lifting assembly is for use in lifting and transporting a bucket of no particular size via a fork of a forklift. The bucket lifting assembly is configured to attach onto opposing side handles of a bucket in order to lift and transport said bucket. The bucket lifting assembly is comprised of a lateral member that connects with vertical members that extend downwardly and engage opposing side handles of the bucket. The vertical members are able to slide laterally with respect to the lateral member so as to adjust for different bucket sizes. The lateral member includes a fort securing member that is affixed from underneath the lateral member such that a forklift fork is inserted and secured there between in order to prevent unintended separation when in use.

15 Claims, 5 Drawing Sheets

BUCKET LIFTING ASSEMBLY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of bucket raising devices, more specifically, a lifting assembly that attached onto an existing bucket, which provides a means for lifting said bucket with forklift forks.

B. Discussion of the Prior Art

As will be discussed immediately below, no prior art discloses a lifting assembly that is configured to attach onto an existing bucket, and which provides a means for lifting and carrying of said bucket via forklift forks; wherein the lifting assembly is comprises of a lateral member that connects with vertical members that extend downwardly and engage opposing sides of a bucket; wherein the vertical members are able to slide laterally with respect to the lateral member so as to adjust for different bucket sizes; wherein the lateral member includes a fork securing member that is affixed from underneath the lateral member such that a forklift fork is inserted and secured there between in order to prevent unintended separation when in use; wherein the vertical members are further defined as including a "J" shaped member rigidly affixed to a bolt member, which passes through a vertical slot provided on the lateral member; wherein the bolt member is secured to the lateral member via a threaded nut; wherein a distal end of the "J" shaped member is adapted to engage a bucket handle located on opposing sides of said bucket such that the "J" shaped member lifts the buck from the respective handles.

The Gallup Patent (U.S. Pat. No. 6,497,006) discloses a removable grip for a five gallon bucket. However, the removable grip is not adapted to lift a bucket from opposing side handles provided on said bucket, and further adapted to be lifted via a single fork of a forklift.

The Curtis Patent (U.S. Pat. No. 4,823,433) discloses a paint bucket handle accessory. Again, the accessory relies on the handle that rotates from opposing sides, and not a lifting assembly that raises a bucket from handgrips integrated into opposing sides.

The Lyver Patent (U.S. Pat. No. 5,445,425) discloses an offset handle and bracket assembly for mounting a handle offset from center on a paint bucket. Again, the assembly is directed to aiding in the lifting of a paint bucket, and which is not adaptively configured for use with a fork of a forklift in order to raise said bucket.

The Lasseigne Patent (U.S. Pat. No. 7,399,017) discloses a bucket harness device for facilitating lifting and tipping of a bucket to empty the contents of the bucket. Again, the device is not suited for use in lifting a bucket of no particular size via a single fork of a forklift.

The Hazelton Patent (U.S. Pat. No. 6,382,691) discloses a detachable handle support for carrying containers. Again, the support is directed to manual lifting of the bucket, and not via a fork of a forklift.

The Holloway Patent (U.S. Pat. No. 5,501,497) discloses an adjustable drum handling carrier. However, the drum does not provide for raising and transporting of said drum via a fork of a forklift from above said drum.

The Kraemer Patent (U.S. Pat. No. 7,284,777) discloses a bucket lifting apparatus. However, the apparatus relies on manual lifting and is not adapted for use with a forklift.

The LaFontaine Patent (U.S. Pat. No. 5,145,226) discloses a paint can holder securable against accidental detachment. Again, the holder is only suited for use with a paint can and not a bucket of no particular size, which is lifted and transported via a fort of a forklift.

The Lund Patent (U.S. Pat. No. Des. 306,507) illustrates an ornamental design for a paint can holder for ladders, which does not accommodate a forklift fort at a central location with respect to the holder.

While the above-described devices fulfill their respective and particular objects and requirements, they do not describe a lifting assembly that is configured to attach onto an existing bucket, and which provides a means for lifting and carrying of said bucket via forklift forks; wherein the lifting assembly is comprises of a lateral member that connects with vertical members that extend downwardly and engage opposing sides of a bucket; wherein the vertical members are able to slide laterally with respect to the lateral member so as to adjust for different bucket sizes; wherein the lateral member includes a fork securing member that is affixed from underneath the lateral member such that a forklift fork is inserted and secured there between in order to prevent unintended separation when in use; wherein the vertical members are further defined as including a "J" shaped member rigidly affixed to a bolt member, which passes through a vertical slot provided on the lateral member; wherein the bolt member is secured to the lateral member via a threaded nut; wherein a distal end of the "J" shaped member is adapted to engage a bucket handle located on opposing sides of said bucket such that the "J" shaped member lifts the bucket from the respective handles. In this regard, the bucket lifting assembly departs from the conventional concepts and designs of the prior art.

SUMMARY OF THE INVENTION

The bucket lifting assembly is for use in lifting and transporting a bucket of no particular size via a fork of a forklift. The bucket lifting assembly is configured to attach onto opposing side handles of a bucket in order to lift and transport said bucket. The bucket lifting assembly is comprises of a lateral member that connects with vertical members that extend downwardly and engage opposing side handles of the bucket. The vertical members are able to slide laterally with respect to the lateral member includes a fork securing member that is affixed from underneath the lateral member such that a forklift fork is inserted and secured there between in order to prevent unintended separation when in use. The vertical members are further defined as including "J" shaped member rigidly affixed to a bolt member, which passes through a vertical slot provided on the lateral member. The bolt member is secured to the lateral member via a threaded nut. A distal end of the "J" shaped member is adapted to engage one of the two bucket handles located on the sides of said bucket such that the "J" shaped member lifts the bucket from the respective handles.

It is an object of the invention to provide a bucket lifting assembly that is adapted to secure onto opposing side handles of a bucket of no particular size, and which enables a fork of a forklift to lift and transport both the bucket and the bucket lifting assembly when in use.

A further object of the invention is to provide a bucket lifting assembly that is comprises of a lateral member from which vertical members attach and extend downwardly in order to engage handles on opposing sides of the bucket being lifted.

An even further object of the invention is to provide a "J" shaped member that is rigidly affixed to a blot member, which passes through a bolt slot provided on the lateral member, and which is secured thereto via a threaded nut.

A further object of the invention is to provide a fork securing member that is affixed and hangs from underneath the lateral member so as to secure the assembly to a fork of a forklift in order to prevent unintended separation there between.

These together with additional objects, features and advantages of the bucket lifting assembly will be readily apparent to those of ordinary skill in the art upon reading the following detailed description of presently preferred, but nonetheless illustrative, embodiments of the bucket lifting assembly when taken in conjunction with the accompanying drawings.

In this respect, before explaining the current embodiments of the bucket lifting assembly in detail, it is to be understood that the bucket lifting assembly is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bucket lifting assembly.

It is therefore important that the claims be regarded as including such equivalent construction insofar as they do not depart from the spirit and scope of the bucket lifting assembly. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 5 illustrates a cross-sectional view of the bucket lifting means in use with a bucket, and further detailing the distal end of the "J" shaped member lifting the bucket from under the handles of said bucket while further depicting the fork securing member and lateral member sandwiching the fork of the forklift there between.

DETAILED DESCRIPTION OF THE EMBODIMENT

Figure 1:
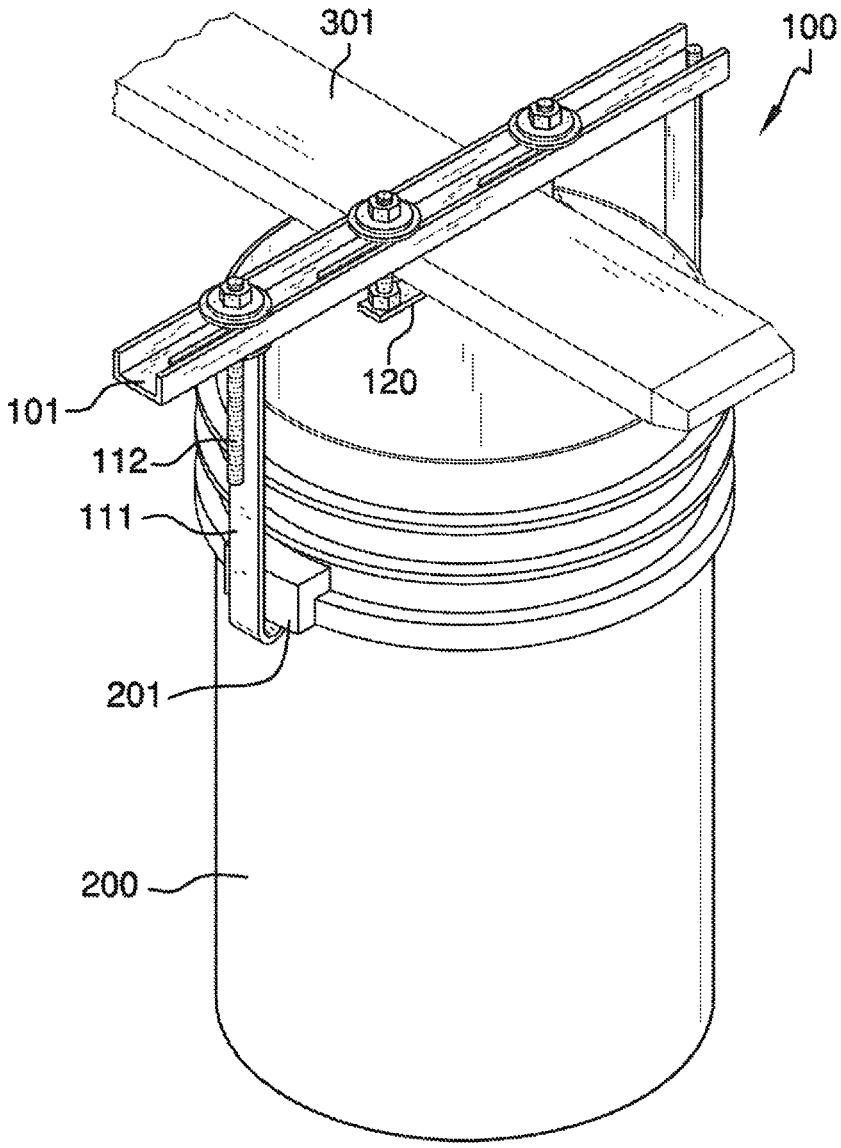
FIG. 1 illustrates a perspective view of the bucket lifting assembly installed on a bucket and in use with a fork of a forklift.
Figure 2:
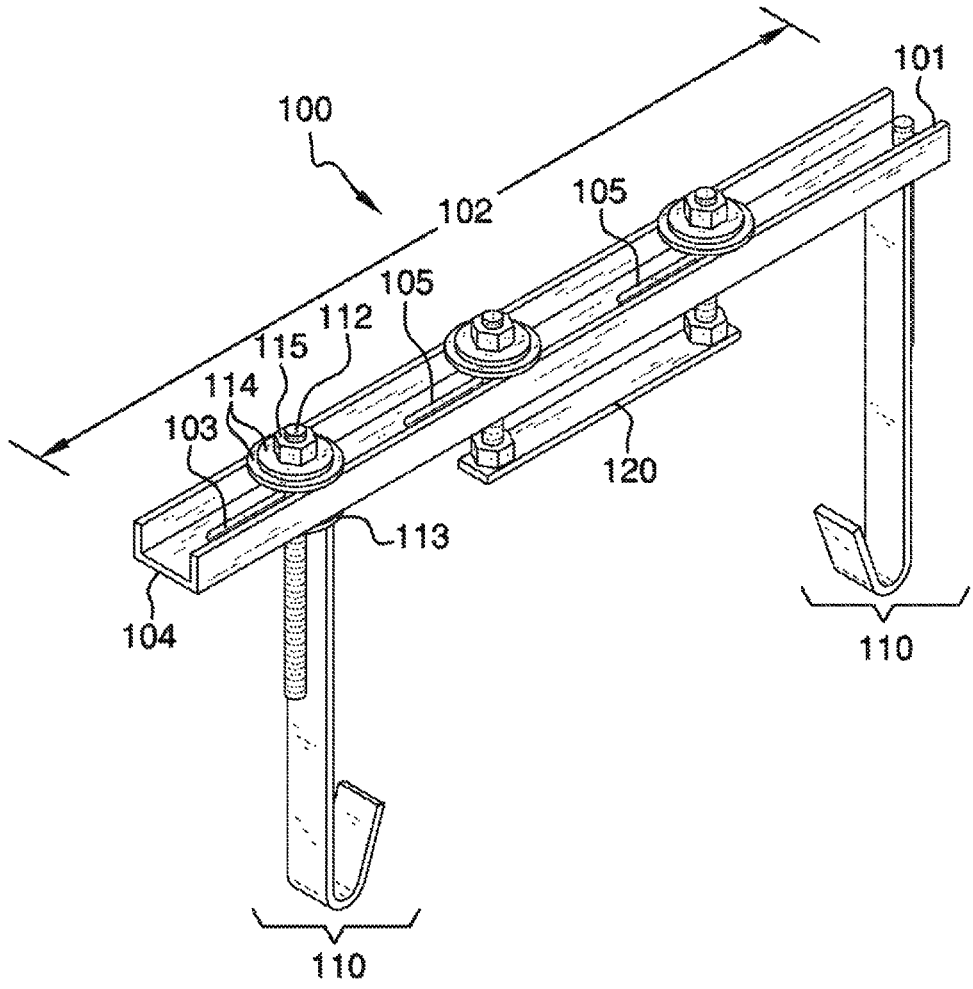
FIG. 2 illustrates a perspective view of the bucket lifting assembly by itself.
Figure 3:
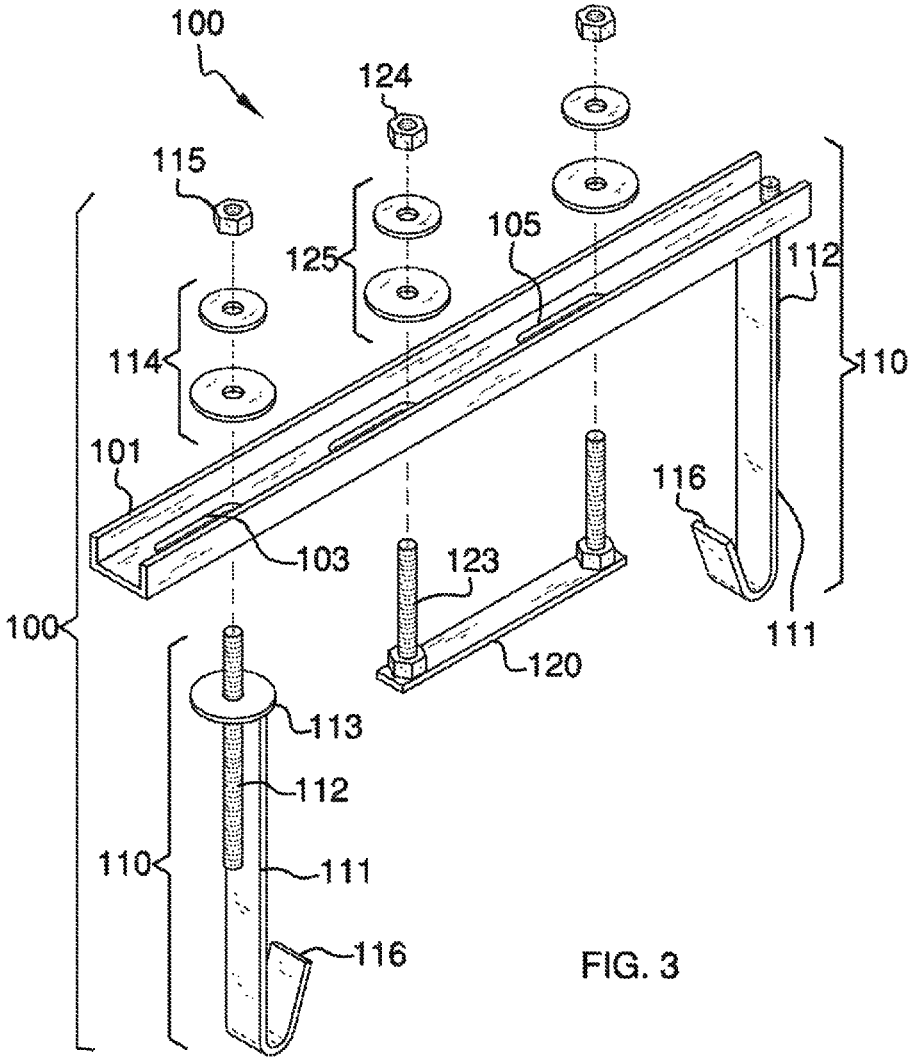
FIG. 3 illustrates an exploded view of the bucket lifting assembly in order to detail the lateral member, vertical member, and fork securing member.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will not be made to the preferred embodiment of the present invention, examples of which are illustrated in FIGS. 1-5. A bucket lifting assembly 100 (hereinafter invention) includes a lateral member 101 that is of an undefined length 102, and which may be constructed of "U" channel. The lateral member 101 includes at least one vertical slot 103 near lateral ends 104. The lateral member 101 also includes fork member slots 105 located between the vertical slots 103.

The invention 100 includes two vertical members 110, which are individually responsible for engaging and lifting a bucket handle 201 of a bucket 200. Moreover, the vertical members 110 grab the bucket handle 201 from opposing sides of the bucket 200. The vertical members 110 are further characterized as including a "J" shaped member 111 that is rigidly affixed to a bolt member 112. The bolt member 112 and the "J" shaped member 111 are of no specific length, and are rigidly affixed to one another at a vertical washer 113. The bolt member 112 extends upwardly from the "J" shaped member 111. The bolt member 112 extends through a respective vertical slot 103 of the lateral member 101, and is secured thereto via at least one secondary washer 114 and threaded nut 115.

Figure 5:
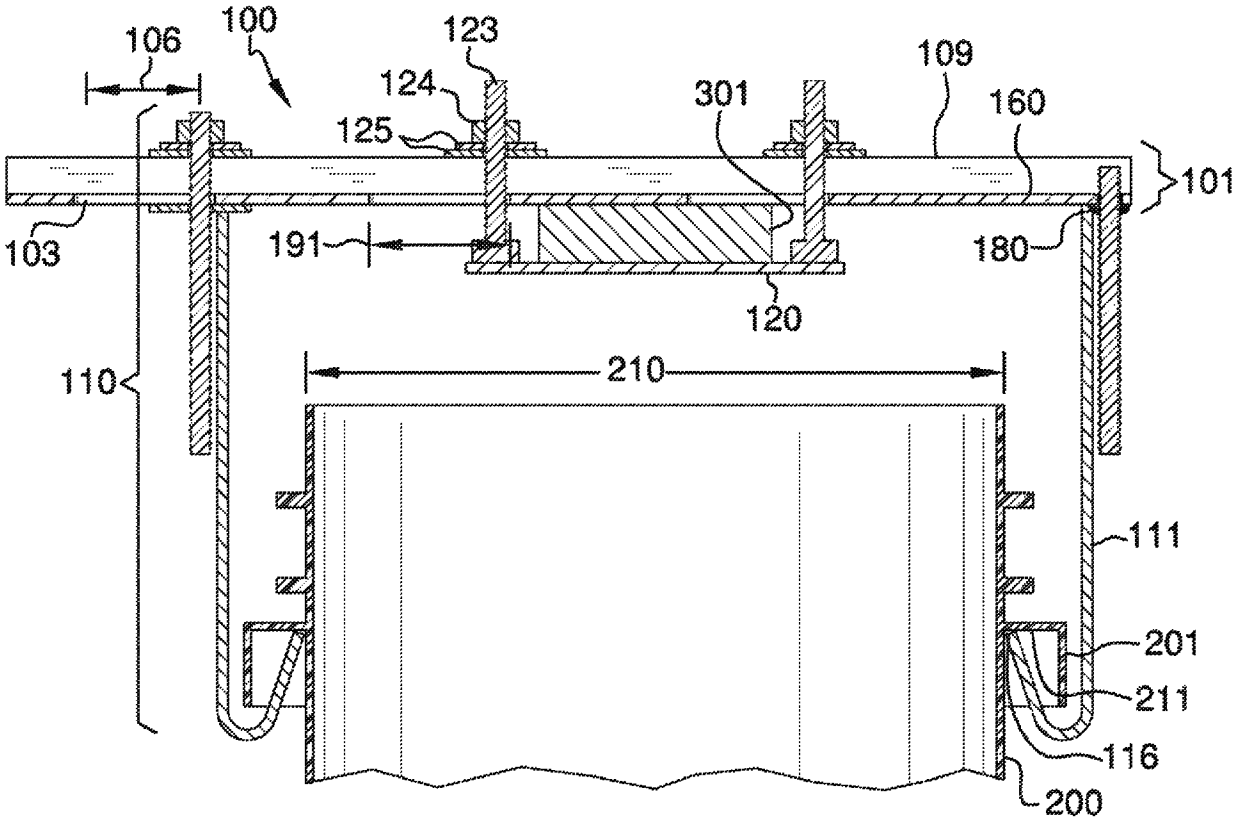

It shall be noted that one of the vertical members 110 may be simply welded or rigidly affixed to the lateral member 101. Referring to FIG. 5, one of the vertical members 110 is rigidly affixed to the lateral member 101 in that the lateral member 101 includes only one vertical slot 103, which accommodates adjustment of and secures the opposing vertical member 110. More specifically, rigid affixment member 180 secures the vertical member 110 to the lateral member 101. The rigid affixment member 180 may be characterized as welding.

The vertical slot 103 of the lateral member 101 shall be further characterized by a vertical slot width 106 (see FIG. 5), which shall define the range in size of the bucket 200 so secured to the invention 100. Moreover, the vertical slot width 106 in connection with a spacing of the vertical slots 103 shall define the range in bucket diameter 210.

The "J" shaped member 111 shall be further characterized by a distal end 116, which is responsible for engaging the bucket handle 201 from underneath. Referring to FIG. 5, the distal ends 116 of the "J" shaped member are snuggly affixed up and under a bottom surface 211 of the bucket handle 201.

Figure 4:
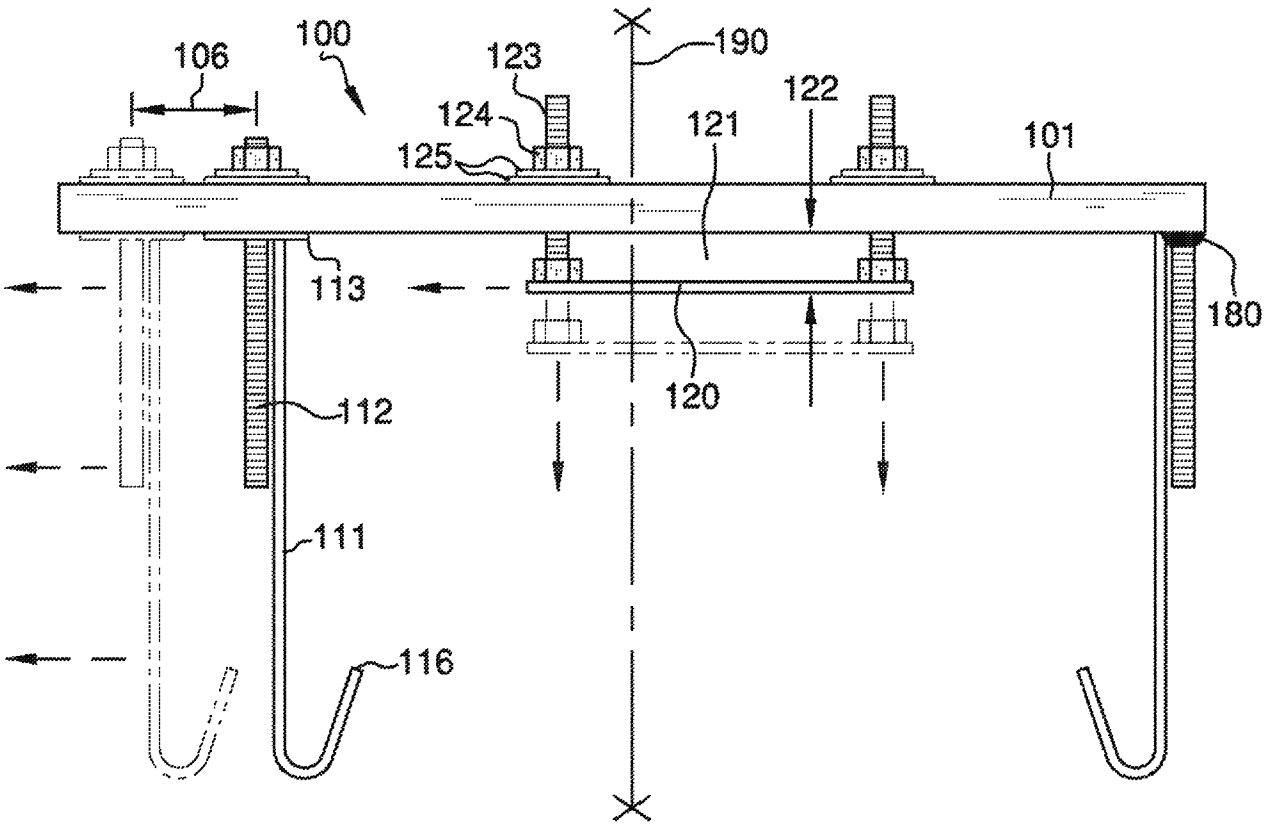
FIG. 4 illustrates a front view of the bucket lifting assembly wherein arrows indicate lateral movement of the vertical members as well as lateral and vertical movement of the fork securing member with respect to the lateral member.

The invention 100 includes a fork securing member 120 that secures itself under the lateral member 101. The fork securing member 120 extends downwardly from the lateral member 101 in order to form an opening 121 into which a fork 301 of a forklift is inserted. The opening 121 is generally rectangular in shape, and is further defined with an opening height 122, which is adjustable (see FIG. 4). The fork securing member 120 is generally parallel with respect to the lateral member 101. The fork securing member 120 is generally positioned near a centerline 190 of the lateral member 101. The fork securing member 120 can slide laterally as depicted in FIG. 4, but is limited by a fork member slot width 191. Obviously, it shall be desirable to balance the weight of the invention 100 along with the bucket 200 closet to the centerline 190 of the lateral member 101.

The fork securing member 120 is further defined as including a pair of fork blot members 123 that extend vertically, and engage the fork member slots 105 of the lateral member 101. Threaded fork nuts 124 and at least one fork washer 125 affix to the fork bolt members 123 from a top surface 109 of the lateral member 101 (see FIG. 5). It shall be noted that the fork washers 125 span across the "U" shaped construction of the lateral member 101. However, the fork washers 125 may be of a smaller size and rest on a lower surface 160 of the lateral member 101.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A bucket lifting assembly comprising:

a lateral member and two vertical members that are adjustably attached to the lateral member and extend downwardly therefrom;

wherein the vertical members are configured to engage bucket handles of a bucket;

wherein the lateral member spans over top of said bucket and includes a fork securing member there under, which are configured to collectively sandwich a fork of a forklift there between in order to raise and transport the bucket; and wherein the lateral member is of an undefined length, and is constructed of "U" channel; wherein the lateral member includes at least one vertical slot near a lateral ends; wherein the lateral member further includes fork member slots located between the lateral ends.

2. The bucket lifting assembly as described in claim 1 wherein the vertical members are further characterized as including a "J" shaped member that is rigidly affixed to a bolt member; wherein the bolt member and the "J" shaped member are of no specific length, and are rigidly affixed to one another at a vertical washer.

3. The bucket lifting assembly as described in claim 2 wherein the bolt member extends upwardly from the "J" shaped member; wherein the bolt member extends through a respective vertical slot of the lateral member, and is secured thereto via at least one secondary washer and threaded nut.

4. The bucket lifting assembly as described in claim 3 wherein the vertical slot of the lateral member is further defined by a vertical slot width, which defines the range in size of the bucket so secured to the bucket lifting assembly; wherein the vertical slot width in connection with a spacing of the vertical slots shall define the range in bucket diameter.

5. The bucket lifting assembly as described in claim 2 wherein the "J" shaped member is further defined by a distal end, which is responsible for engaging the bucket handle from underneath; wherein the distal ends of the "J" shaped member are snuggly affixed up and under a bottom surface of the bucket handle.

6. The bucket lifting assembly as described in claim 3 wherein the fork securing member secures itself under the lateral member in order to form an opening into which the fork is inserted; wherein the opening is generally rectangular in shape, and is further defined with an opening height, which is adjustable.

7. The bucket lifting assembly as described in claim 4 wherein the fork securing member is generally parallel with respect to the lateral member; wherein the fork securing member is generally positioned near a centerline of the lateral member; wherein the fork securing member is able to slide laterally, but is limited by a fork member slot width.

8. The bucket lifting assembly as described in claim 5 wherein the fork securing member is further defined as including a pair of fork bolt members that extend vertically, and engage the fork member slots of the lateral member; wherein threaded fork nuts and at least one fork washer affix to the fork bolt members from a top surface of the lateral member.

9. A bucket lifting assembly comprising:

a lateral member and two vertical members that are adjustably attached to the lateral member and extend downwardly therefrom;

wherein the vertical members are configured to engage bucket handles of a bucket;

wherein the lateral member spans over top of said bucket and includes a fork securing member there under, which are configured to collectively sandwich a fork of a forklift there between in order to raise and transport the bucket;

wherein the lateral member is of an undefined length, and is constructed of "U" channel;

wherein the lateral member includes at least one vertical slot near a lateral ends; wherein the lateral member further includes fork member slots located between the lateral ends;

wherein the vertical members are further characterized as including a "J" shaped member that is rigidly affixed to a bolt member; wherein the bolt member and the "J" shaped member are of no specific length, and are rigidly affixed to one another at a vertical washer.

10. The bucket lifting assembly as described in claim 9 wherein the bolt member extends upwardly from the "J" shaped member; wherein the bolt member extends through a respective vertical slot of the lateral member, and is secured thereto via at least one secondary washer and threaded nut.

11. The bucket lifting assembly as described in claim 10 wherein the vertical slot of the lateral member is further defined by a vertical slot width, which defines the range in size of the bucket so secured to the bucket lifting assembly; wherein the vertical slot width in connection with a spacing of the vertical slots shall define the range in bucket diameter.

12. The bucket lifting assembly as described in claim 11 wherein the "J" shaped member is further defined by a distal end, which is responsible for engaging the bucket handle from underneath; wherein the distal ends of the "J" shaped member are snuggly affixed up and under a bottom surface of the bucket handle.

13. The bucket lifting assembly as described in claim 12 wherein the fork securing member secures itself under the lateral member in order to form an opening into which the fork is inserted; wherein the opening is generally rectangular in shape, and is further defined with an opening height, which is adjustable.

14. The bucket lifting assembly as described in claim 13 wherein the fork securing member is generally parallel with respect to the lateral member; wherein the fork securing member is generally positioned near a centerline of the lateral member; wherein the fork securing member is able to slide laterally, but is limited by a fork member slot width.

15. The bucket lifting assembly as described in claim 14 wherein the fork securing member is further defined as including a pair of fork bolt members that extend vertically, and engage the fork member slots of the lateral member; wherein threaded fork nuts and at least one fork washer affix to the fork bolt members from a top surface of the lateral member.

* * * * *